US005393252A

United States Patent [19]

Brogdon

[11] Patent Number: 5,393,252

[45] Date of Patent: Feb. 28, 1995

[54] FRESH WATER FLUSHING SYSTEM

[76] Inventor: Douglas Brogdon, 10570 Front Beach Rd., Panama City Beach, Fla. 32407

[21] Appl. No.: 224,039

[22] Filed: Apr. 7, 1994

[51] Int. Cl.[6] ..... B63H 21/10

[52] U.S. Cl. ..... 440/88

[58] Field of Search ..... 440/88, 89; 114/198, 114/255; 134/169 R; 123/41.01, 41.08, 41.14; 251/356, 512; 137/112

[56] References Cited

U.S. PATENT DOCUMENTS 4,619,618 10/1986 Patti ..... 440/88
5,051,104 9/1991 Guhlin ..... 440/88
5,071,377 12/1991 Saunders et al. ..... 440/88
5,123,369 6/1992 Gross ..... 440/88
5,137,482 8/1992 Hull et al. ..... 440/88
5,295,880 3/1994 Parker ..... 440/88

*Primary Examiner*—Stephen P. Avila
*Attorney, Agent, or Firm*—Carnes, Cona & Dixon

[57] ABSTRACT

A fresh water flushing system for a marine engine system in a boat for use whether the boat is in or out of the water is disclosed. The system comprises a control panel mounted in the proximity of the marine engine and a fresh water flush valve, Hoses are connected to the fresh water flush valve and to various components of the marine engine system to provide for fresh water fluid flow within the engine. Alternates embodiments are included for marines vessels with more than one engine.

17 Claims, 7 Drawing Sheets

FRESH WATER FLUSHING SYSTEM

BACKGROUND OF THE INVENTION

1. Field of the Invention

The present invention relates to a fresh water flushing system for marine engines, and in particular to a fresh water flushing system that expels entrained sea water from a raw sea water cooling conduit of the marine engine, whether the boat is in or out of the water, and irrespective of whether the engine is running or is shut off.

2. Description of the Prior Art

Efforts are constantly being taken to improve fresh water flushing systems for marine engines. Fresh water flushing is recommended universally by every marine engine manufacturer. Flushing fresh water through a marine engine substantially prolongs the life of the equipment, lowers the maintenance costs, and protects the significant investment in the engine itself.

Current systems treat the cooling system as a single cavity, as opposed to a group of cavities, water pathways, and equipment. Traditional flushing systems currently available are time consuming to use, error prone, and in many cases just not feasible to use for commercial crafts or pleasure crafts.

For example, most flushing devices cannot be used if the boat is lifted from the water by a davit or is stored in a boathouse. Current flushing equipment usually requires the engine to be running while the boat out of the water. Under certain condition, flushing the engine can be hazardous. The current flushing system have limitations on convenience and reliability that make them user unfriendly. Most current systems merely relocate salt and mineral residues to another location within the cooling system.

SUMMARY OF THE INVENTION

The present invention is defined by the appended claims with the specific embodiments shown in the attached drawings. For the purpose of summarizing the invention, the present invention may be incorporated into a fresh water flushing system for displacing sea water in a large size marine engine whether the boat is in or out of the water. The fresh water flushing system of the present invention comprises a control panel mounted on an interior of the boat having a fresh water supply connection, a fresh water flush valve assembly having an inlet port for receiving the flow of fresh water, a plurality of axial outlet ports for proportionally discharging the flow of fresh water, and one or more fresh water conduits for providing the flow of fresh water from the control panel to the fresh water flush valve assembly. The present invention is constructed so as to resist the corrosive effects of salt water.

The flushing system of the present invention does not require that the marine vessel be removed from the water for the flushing process to commence. The engine need not be operating during the flushing process.

The present invention may be incorporated in several types of large cubic inch displacement marine engine systems. These engine systems include: engines equipped with gill manifolds, super chargers, custom marine headers, turbo chargers, and other similarly equipped engine systems. The flushing system of the present invention may be incorporated into existing engine systems.

Therefore, it is an object of the present invention to provide a fresh water flushing system to expel entrained sea water from a raw sea water cooling conduit of a marine engine whether the boat is in or out of the water.

It is another object of the present invention to provide a fresh water flushing system that works with a variety of marine engine systems that are equipped with gill manifolds, super chargers, custom manifold, turbo chargers, and the like.

It is another object of the present invention to provide a fresh water flushing system that can be easily retrofitted into existing boats.

It is another object of the present invention to provide a fresh water flushing system that proportions the flow of fresh water to each sub-system and component of the cooling system to insure correct filling and draining of the cooling system to remove harmful minerals and salts and other residues from the cooling system.

It is another object of the present invention to provide a fresh water flushing system that can be easily incorporated as an Original Equipment Manufactured (OEM) component for newly manufactured boats.

It is another object of the present invention to provide a fresh water flushing system that will resist the corrosive effects of salt air and sea water on the fixed and movable working parts of the invention.

It is another object of the present invention to provide a fresh water flushing system that will not impair the operational performance of the marine engine when the fresh water flushing system is not in use.

It is a final object of the present invention to be specifically enumerated herein is to provide a fresh water flushing system in accordance with the preceding objects and which will conform to conventional forms of manufacture, be of simple construction, and be easy to use, so as to provide a device that is economically feasible, long lasting and relatively trouble free in operation, and will provide superior flushing performance.

The foregoing has outlined some of the more pertinent objects of the invention. These objects should be construed to be merely illustrative of some of the more prominent features and applications of the intended invention. Many other beneficial results can be obtained by applying the disclosed invention within the scope of the disclosure. Accordingly, other objects and a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
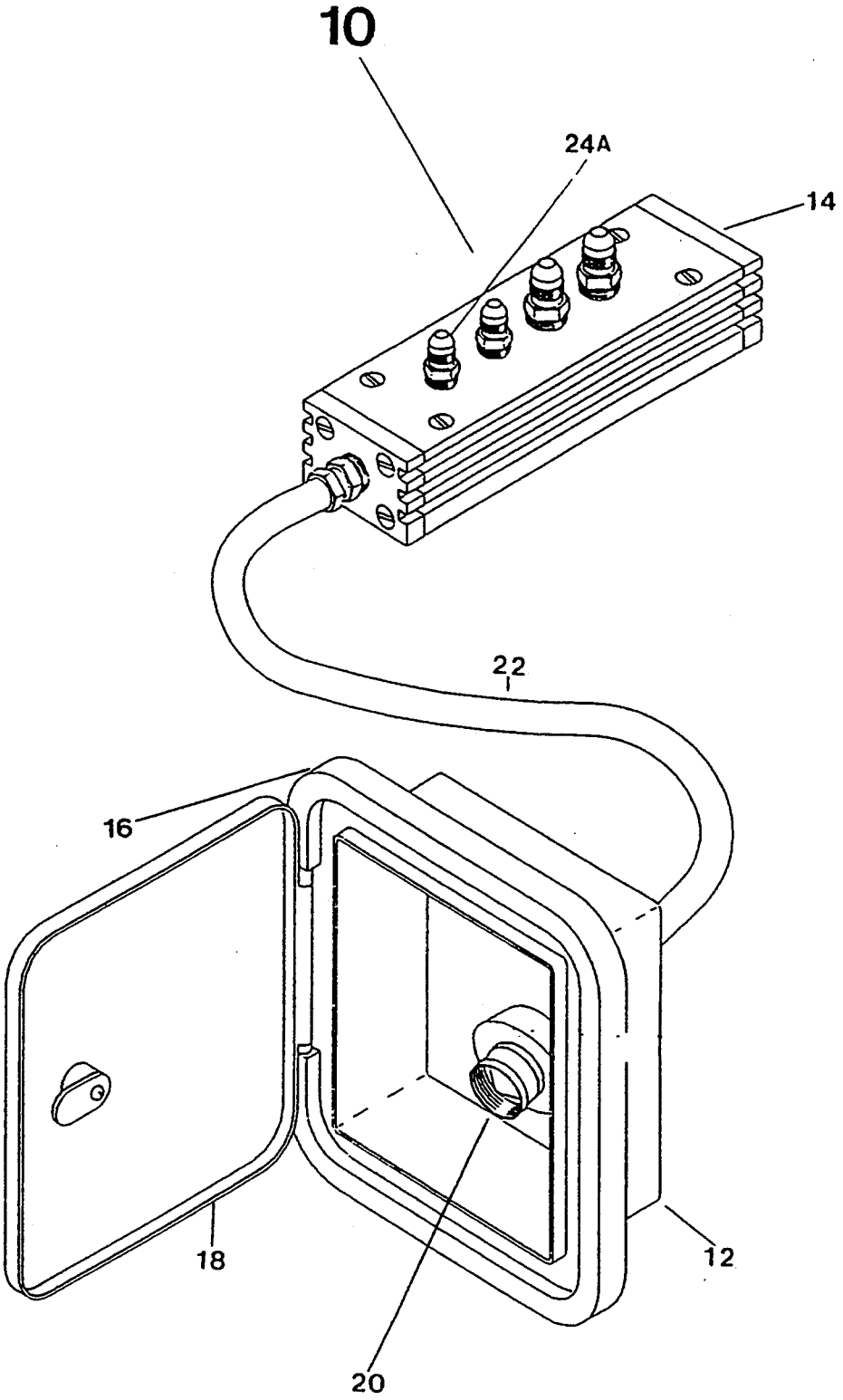
FIG. 1 is a perspective view of the first embodiment of the flushing system of the present invention.

The flushing system 10 of the present invention is located in close proximity to the engine of a marine vessel. The first embodiment of the flushing system is illustrated in FIG. 1. As seen in this figure, the flushing system 10 consists of a control panel 12 and a fresh water valve assembly 14 having a valve (not illustrated) and a first set of discharge ports 24A.

The control panel 12 includes a housing 16 having a door 18. Internally located in the housing 16 is a fresh water supply connector 20. The fresh water supply connector 20 is connected to the fresh water conduit 22 and is adapted to receive a dockside source of fresh water (not illustrated). This fresh water conduit 22 is attached to the fresh water valve assembly 14. The source of fresh water (for example a standard hose line) is attachable to and detachable from the fresh water supply connector 20 and allows for fresh water to flow freely into the fresh water conduit 22 and to the fresh water valve assembly 14 which routes the fresh water to various areas in the engine through the first set of discharge ports 24A. The fresh water valve assembly is illustrated in further detail in FIGS. 4–6.

Figures 2A, 2B:
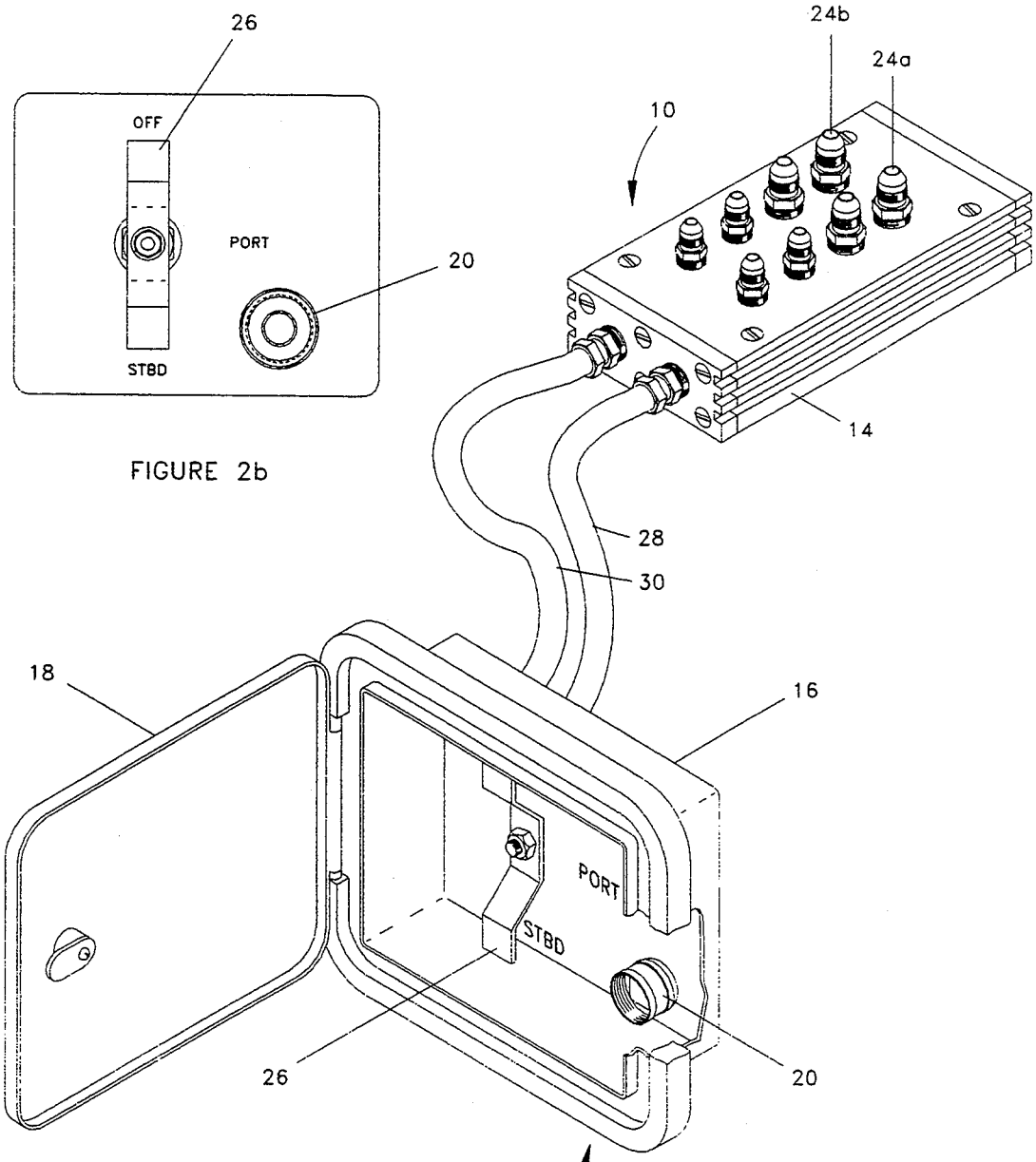
FIG. 2*a* is a perspective view of the second embodiment of the flushing system of the present invention.
FIG. 2*b* is a front view of the control panel of the second embodiment of the present invention.

To accommodate for a boat having twin engines, the flushing system of the present invention can be modified as illustrated in FIGS. 2*a* and 2*b*. The flushing system 10 of the second embodiment allows for the engines to be flushed individually (port and starboard). This second embodiment includes a control panel 12 and a fresh water valve assembly 14 having two valves (not illustrated) and two sets of discharge ports 24A, 24B. The control panel includes a housing 16 having a door 18. Internally located in the housing is a fresh water supply connector 20 and a 180-degree valve 26. The fresh water supply connector 20 is connected to the fresh water conduit (not illustrated) and is also adapted to receive a dockside source of fresh water (not illustrated). The source of fresh water (for example a standard hose line) is attachable to and detachable from the fresh water supply connector 22 and allows for fresh water to flow freely into the fresh water conduit. This fresh water conduit also interconnects with the 180-degree valve 26. A starboard fresh water conduit 28 and a port fresh water conduit 30 are each connected to the 180-degree valve 26 and the fresh water valve assembly 14. The 180-degree valve 26 regulates and modulates the flow of fresh water, as it travels from the source of fresh water to the fresh water valve assembly 14.

The 180-degree valve 26 enables a user to isolate the desired engine which is to be flushed. To permit this option, the fresh water valve assembly 14 is equipped with two valves (not illustrated) with each valve having a set of discharge ports 24A (starboard), 24B (port) which are adapted to allow water to flow to their respective sections on the desired engine.

Figures 3A, 3B:
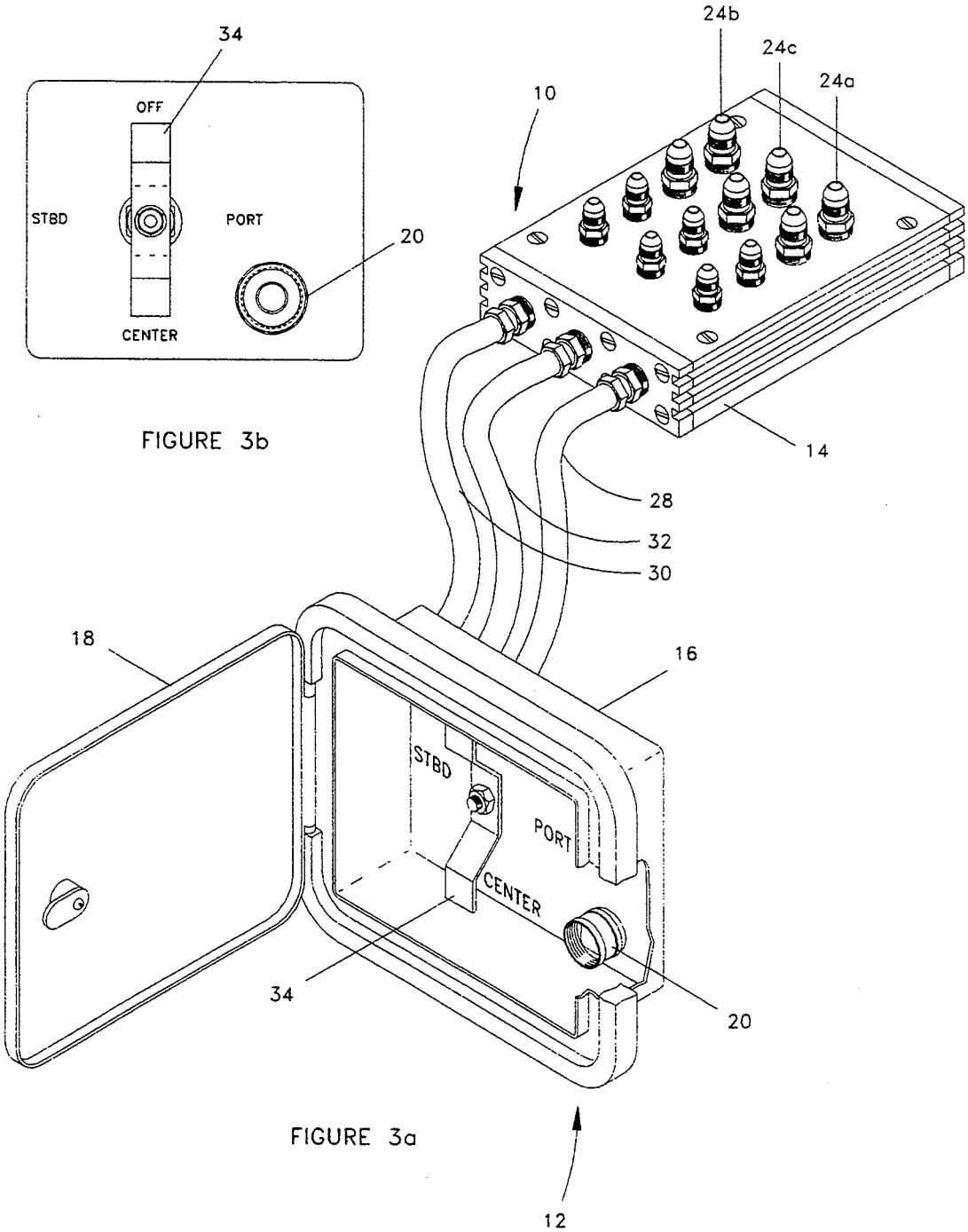
FIG. 3*a* is a perspective view of the third embodiment of the flushing system of the present invention.
FIG. 3*b* is a front view of the control panel of the third embodiment of the present invention.

The third embodiment of the present invention allows for the flushing system to be utilized with a vessel having triple engines. The third embodiment of the present invention is illustrated in FIGS. 3*a* and 3*b*. The flushing system 10 of the third embodiment allows for a 3-way (port, starboard, center) flushing of the engines to be accomplished individually. This third embodiment includes a control panel 12 and a fresh water valve assembly 14 having three valves (not illustrated) and three sets of discharge ports 24A, 24B, 24C.

The control panel includes a housing 16 having a door 18. Internally located in the housing is a fresh water supply connector 20 and a four way valve 34. The fresh water supply connector 20 is connected to the fresh water conduit (not illustrated) and is also adapted to receive a dockside source of fresh water (not illustrated). The source of fresh water (for example a standard hose line) is attachable to and detachable from the fresh water supply connector 22 and allows for fresh water to flow freely into the fresh water conduit. This fresh water conduit also interconnects with the four way valve 34. A starboard fresh water conduit 28, a port fresh water conduit 30, and a center fresh water conduit 32 are each connected to the four way valve 34 and the fresh water valve assembly 14. The four way valve 34 regulates and modulates the flow of the fresh water as it travels from the source of fresh water to the fresh water valve assembly.

The four way valve 34 enables a user to isolate the desired engine which is to be flushed. To permit this option, the fresh water valve assembly is equipped with three valves (not illustrated) with each valve having a set of discharge ports 24A (starboard), 24B (port), and 24C (center) which are adapted to allow water to flow to their respective sections on the desired engine.

Figure 4:
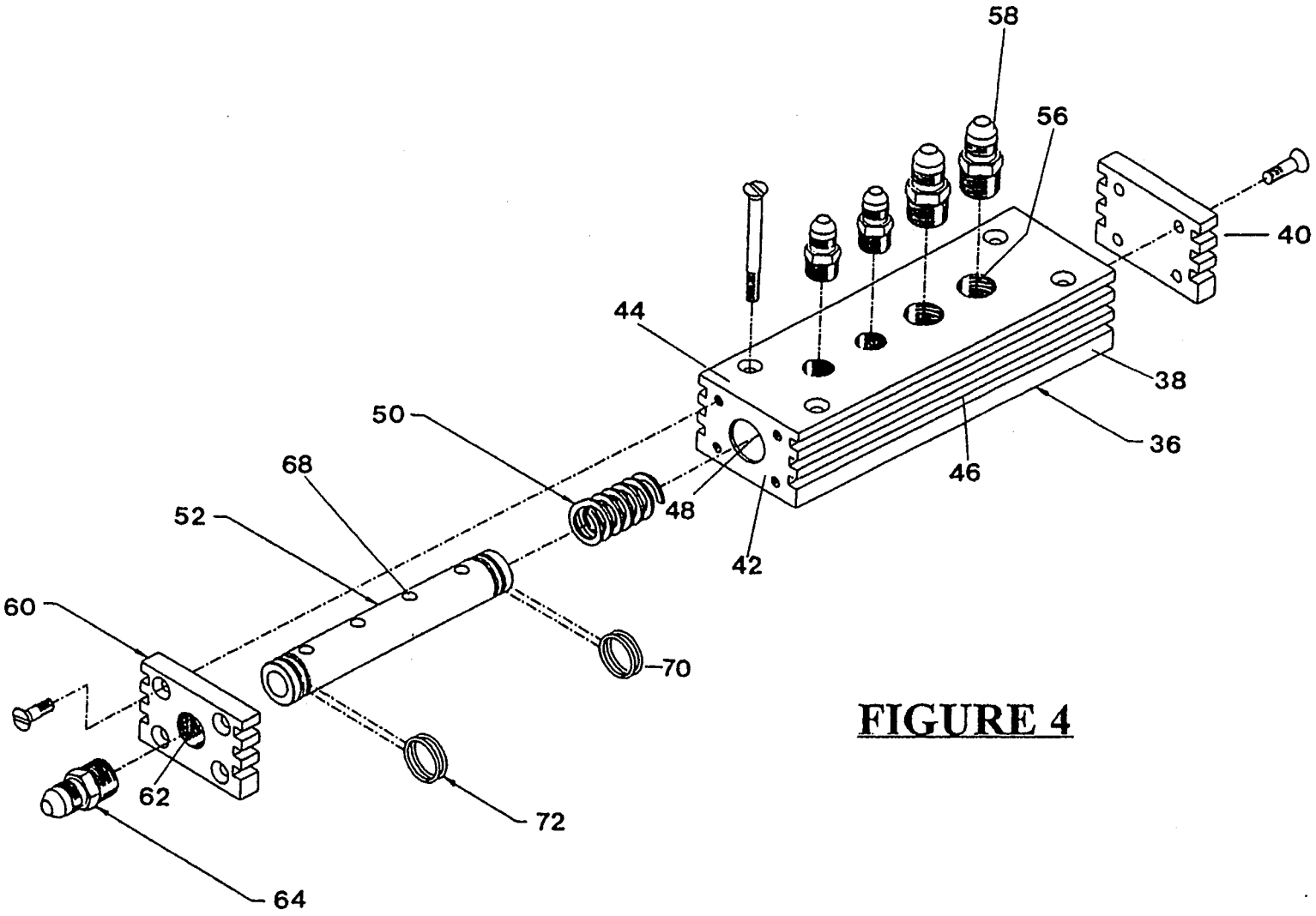
FIG. 4 is an exploded longitudinal perspective view of the fresh water valve assembly showing the components of the flush valve prior to assembly.
Figure 5:
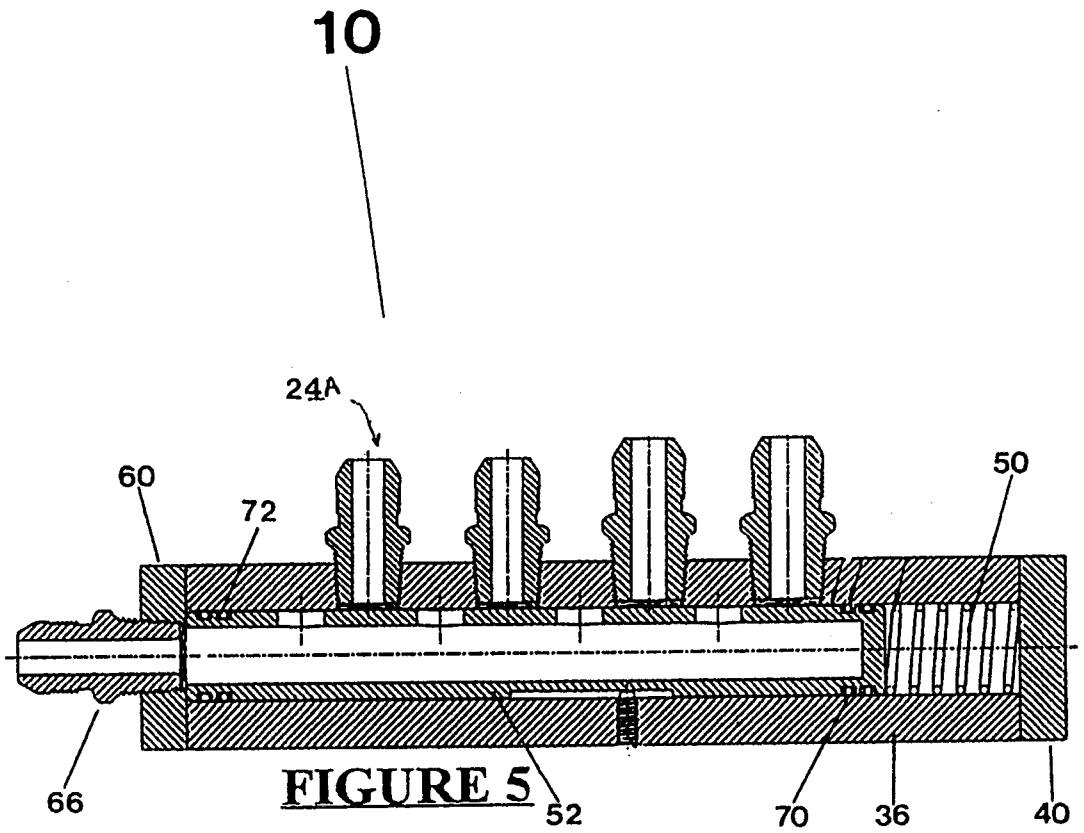
FIG. 5, is a cross-sectional view of the fresh water valve assembly in a closed position.
Figure 6:
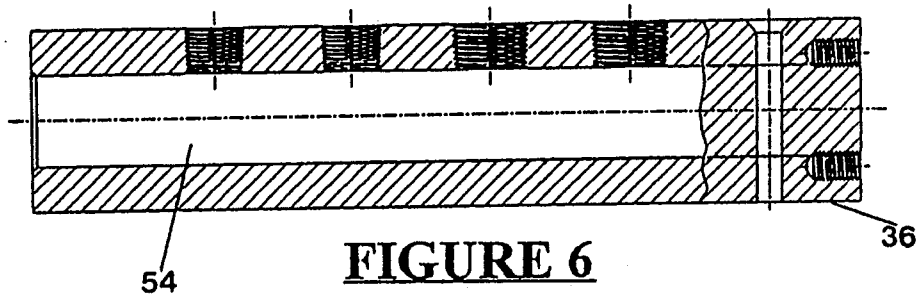
FIG. 6 is a cross-sectional view of the housing of the fresh water valve assembly.

The fresh water valve assembly is illustrated in further detail in FIGS. 4–6. As seen in these figures, the fresh water valve assembly 14 includes a housing or body 36. This housing or body has a rectangular shape and consist of a first side 38 parallel to a second side (not illustrated), a third side 40 parallel to a fourth side and a top side 44 parallel to a bottom side (not illustrated. The first and second sides are identical in shape, design and configuration. The first and second sides include a plurality of fins 46. These fins act as heat sinks and dissipate heat when the flushing system of the present invention is being utilized.

The third side 40, also known as the end cap is securely fastened to the first, second, top, and bottom sides. This third side or end cap can be formed integrally with the first, second, top, and bottom sides.

The fourth side 42 is formed integrally with the first, second, top, and bottom sides. This fourth side 42 also includes an opening 48 for receiving a bias spring 50 and a plunger 52. This bias spring 50 and plunger 52 are maintained within a cavity 54 of the housing or body.

The top side 44 of the housing or body includes a plurality of openings 56. Adapters 58 may be inserted into the openings 56 in order to accommodate and provide a secure fit for the plurality of fresh water hoses (not illustrated in these figures). The openings alone, or the openings in combination with the adapters, form the set of discharge ports 24 (labeled as 24A in FIG. 1, 24A, and 24B in FIG. 2, and 24A, 24B, and 24C in FIG. 3).

Attached to the fourth side of the housing or body is a front plate 60. This front plate maintains the plunger within the cavity. The front plate further includes an opening 62. An adapter 64 may be inserted into the opening in order to accommodate and provide a secure fit for the fresh water conduits (not illustrated in this figure, but illustrated in FIG. 1 as 22, in FIG. 2 as 28 and 30, and in FIG. 3 as 28, 30, and 32). The opening alone, or the opening in combination with the adapter, form a fresh water inlet 66.

The bias spring 50 abuts the third side or end cap 40, and the valve plunger 52.

The valve plunger 52 further includes a plurality of openings forming metering ports 68. The valve plunger 52 moves linearly when it is pressurized with the fresh water. This movement of the valve plunger causes the spring to compress into a bias status. It also provides for the metering holes to align with the discharge ports establishing fresh water fluid communication between the metering ports and discharge ports.

When the fresh water pressure is relieved, the status of the spring 50 is reversed. The spring 50 returns to an unbiased, normally closed status. The valve plunger 52 returns linearly to its normally closed position. This causes the metering ports to fall out of alignment with the discharge ports thereby disconnecting the fresh water fluid communication between the metering ports and discharge ports (illustrated in FIG. 5).

A first set of O-rings 70 and a second set of O-rings 72 are attached to both ends of the valve plunger 52 and contact the housing or body of the valve assembly. These sets of O-rings provide adequate sealing means to restrict back flow of fresh water to the control panel when the flushing process is completed. When the flushing system is not in use, the first and second set of O-rings prevent sea water from entering the control panel.

To accommodate for twin engines (the second embodiment), the housing or body is equipped with a second cavity. A second valve plunger, having two sets of O-rings, that is identical in shape, size and design as illustrated in FIGS. 4–6, and a second bias spring are situated inside the cavity in the same configuration as disclosed in FIGS. 4–6. The fourth side of the housing is altered to include a second opening for receiving the second valve plunger and second bias spring. The top of the housing includes a second set of openings (identical in shape and design as the first set of openings) and can include adapters to provide for discharge ports. The front plate is provided with an additional opening and an optional adapter so that both a starboard conduit and a port conduit can be accommodated.

To accommodate for triple engines (the third embodiment), the housing or body is equipped with three cavities. Within each cavity is a valve plunger, having two sets of O-rings, that is identical in shape, size, and design as illustrated in FIGS. 4–6, and a bias spring. The valve plungers and the bias springs are located within the cavities in the same configuration as disclosed in FIGS. 4–6. The top of the housing includes three set of openings and can include adapters to provide for discharge ports, which are illustrated in FIG. 3. The front plate is provided with three openings and optional adapters to accommodate for a starboard, port, and center conduits.

To utilize the flushing system of the present invention, a fresh water line, such as a hose (not illustrated), is attached to the fresh water supply connector. This allows fresh water to flow into the fresh water conduit. If the control panel is provided with a valve, such as illustrated in the second and third embodiments of the present invention, then it is rotated to a desired open position (to isolate the desired engine to be flushed). This establishes a pressurized fresh water flow to the fresh water flushing valve through a fresh water conduit (as selected by the valve).

The fresh water then enters the flush valve through the inlet port or front cap. The fresh water flow pressure moves the valve plunger to an open status (aligning the metering ports with the discharge ports), causing the spring to compress. The fresh water flows through an inlet port and then through the metering ports, which are disposed on the valve plunger, and is routed to the discharge ports.

Figure 7:
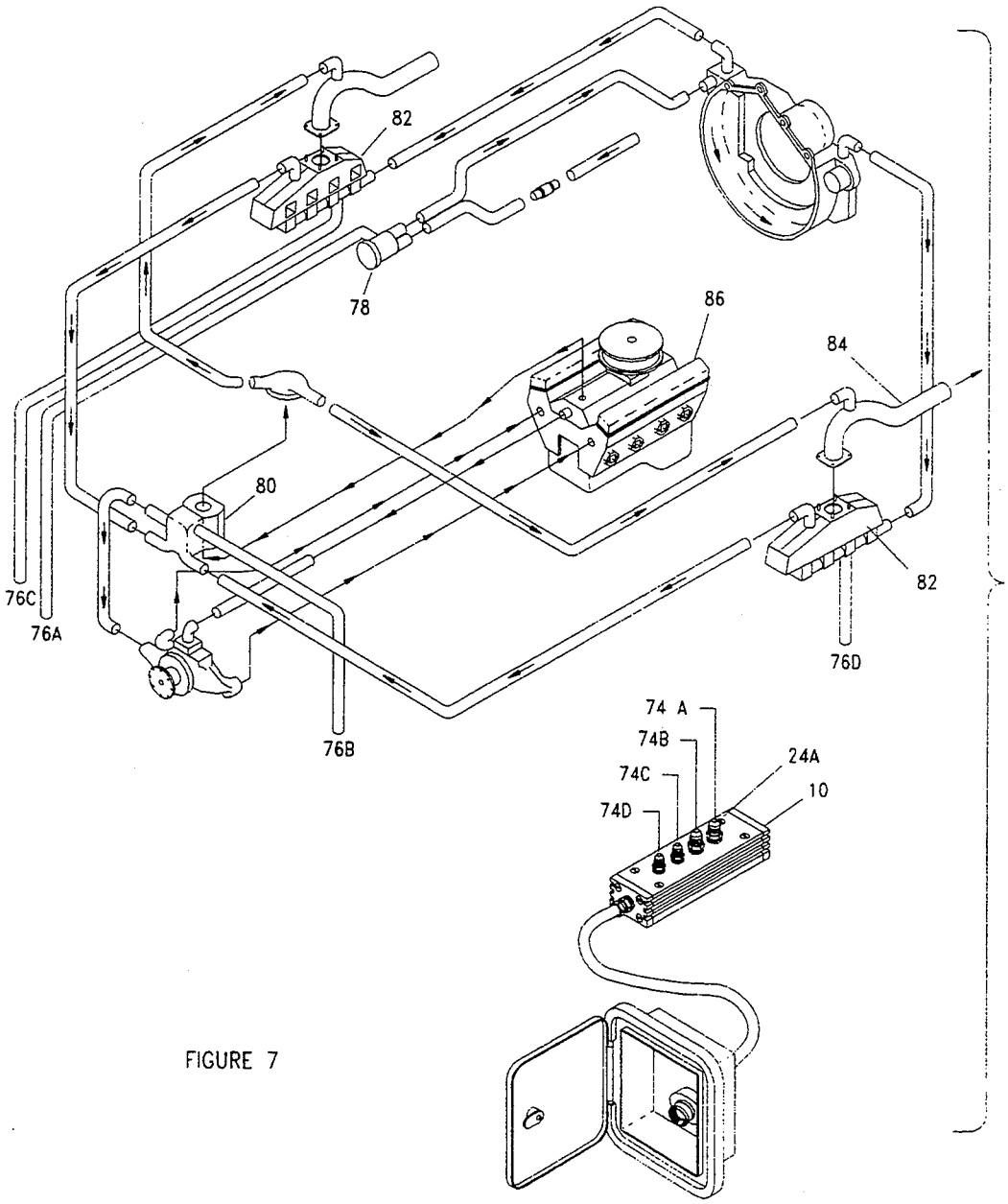
FIG. 7 is a conceptual flow diagram showing the interconnection of the proportioning flush valve system of the first embodiment connected to a typical marine engine.

The fresh water exits the housing or body through a plurality of axial discharge ports, and enters the various areas of the engine through a variety of hoses (illustrated in FIG. 7). The fresh water flushes entrained sea water from these various areas of the engine.

When fresh water is detected exiting the engine, the operator turns off the source of fresh water, and if provided, closes the valve on the control panel. As the fresh water flow pressure returns to zero, the spring returns to an unbiased position thereby pushing the plunger to a closed position.

An example of fresh water flowing through an engine 86 utilizing the first embodiment of the present invention is illustrated in FIG. 7. As seen in this conceptual flow diagram, proportioning flush valve 14 of the flushing system 10 includes four individual discharge ports 74A, 74B, 74C, 74D, within the set of discharge ports 24A. Hose lines (76A, 76B, 76C, 76D) are attached to each discharge port, one line to each port. These hose lines route the fresh water to the various areas of the marine engine system.

As illustrated in this figure, the first hose line 76A is attached to the first discharge port 74A. This first hose line allows for fresh water to enter and flush the sea water pick-up pump 78. The second hose line 76B is attached to the second discharge port 74B. This second line allows for fresh water to enter and flush the thermostat housing 80. The third hose line 76C is attached to the third discharge port 74C and the fourth hose line 76D is attached to the fourth discharge port 76D. Each line allows fresh water to enter and flush the marine engine at the tuned exhaust header 82. The flushed salt water exits the marine engine through the exhaust tube 84.

The present invention is able to flush the entrained sea water from the raw sea water cooling conduit without pulling the boat from the water. The owner can operate the flushing system while the boat is in a slip with the engine off. This ease of operation will encourage more frequent flushing of the raw sea water cooling conduit and hence, significantly increase the reliability of the engine system and the safety of the boat's occupants. Engine system life will be increased significantly since corrosion of the engine system will be dramatically retarded.

While the invention has been particularly shown and described with reference to embodiments thereof, it will be understood by those skilled in the art that various changes in form and detail may be made without departing from the spirit and scope of the invention.

I claim:

1. A flushing system for a marine engine in a boat for use whether said boat is in or out of a body of water comprising in combination:

a control panel;

said control panel is mounted interiorly on said boat;

said control panel includes a fresh water supply connector;

said fresh water supply connector includes a means for attaching and detaching a pressurized fresh water fluid line in order to allow for a flow of fresh water to enter into said control panel when said pressurized fresh water fluid line is attached to said fresh water supply connector;

a fresh water valve assembly;

said fresh water valve assembly has a housing, a valve plunger and a bias spring;

said housing includes an interior chamber;

said housing includes a top, a bottom, a first wall, a second wall, a third wall, and a fourth wall;

said top is parallel to said bottom;

said first wall is parallel to said second wall;

said third wall is parallel to said fourth wall;

said top includes a first set of discharge ports;

said discharge ports are located above said interior chamber;

a fresh water inlet port for receiving said flow of fresh water is located in said fourth wall;

said valve plunger is located in said interior chamber of said housing;

said valve plunger include a set of metering ports;

said set of metering ports faces said top of said housing;

said valve plunger includes a first end and a second end;

said first end faces said fourth wall of said housing;

said bias spring is located in said interior chamber of said housing and has a first end portion and a second end portion;

said first end portion of said bias spring contacts said third wall of said housing;

said second end portion of said bias spring contacts said second end of said valve plunger;

a fresh water conduit;

said fresh water conduit is adapted for urging said flow of fresh water between said control panel and said fresh water valve assembly;

a set of hoses;

said set of hoses is connected to said set of discharge ports of said fresh water flush valve;

said set of hoses is adapted for urging said flow of fresh water to said variety of areas of said marine engine; and wherein said flow of fresh water enters said first fresh water inlet port and provides for said first valve plunger to linearly move forward and compress said first bias spring, causing said first set of metering ports to align with said first set of discharge ports and allow said fresh water to flow into said first set of hoses.

2. The flushing system as in claim 1 wherein said first wall and said second wall include a plurality of elongated fins extending outwardly.

3. The flushing system as in claim 1 wherein a front cap is attached to said fourth wall to maintain said plunger within said first cavity; and said first fresh water inlet port extends though said fourth wall.

4. The flushing system as in claim 1 wherein said first end of said first valve plunger includes a first set of O-rings; and said second end of said first valve plunger includes a second set of O-rings.

5. The flushing system as in claim 1 wherein said first fresh water conduit is attached to said fresh water supply connector and said fresh water inlet port.

6. A flushing system for a first marine engine and a second marine engine in a boat for use whether said boat is in or out of a body of water comprising in combination:

a control panel;

said control panel is mounted interiorly on said boat;

said control panel includes a fresh water supply connector and a control valve;

said fresh water supply connector includes a means for attaching and detaching a pressurized fresh water fluid line in order to allow for a flow of fresh water to enter into said control panel when said pressurized fresh water fluid line is attached to said fresh water supply connector;

a fresh water valve assembly;

said fresh water valve assembly has a housing, a first valve plunger, a second plunger, a first bias spring, and a second bias spring;

said housing includes a first interior chamber, and a second interior chamber;

said housing includes a top, a bottom, a first wall, a second wall, a third wall, and a fourth wall;

said top is parallel to said bottom;

said first wall is parallel to said second wall;

said third wall is parallel to said fourth wall;

said top includes a first set of discharge ports and a second set of discharge ports;

said first set of discharge ports is located above said first interior chamber;

said second set of discharge ports is located above said second interior chamber;

a first fresh water inlet port and a second fresh water inlet port for receiving said flow of fresh water are located in said fourth wall;

said first valve plunger is located in said first interior chamber of said housing;

said second valve plunger is located in said second interior chamber of said housing;

said first valve plunger includes a first set of metering ports;

said first set of metering ports faces said top of said housing;

said second valve plunger includes a second set of metering ports;

said second set of metering ports faces said top of said housing;

said first valve plunger includes a first end and a second end;

said first end faces said fourth wall of said housing;

said second valve plunger includes a first end area and a second end area;

said first end area faces said fourth wall of said housing;

said first bias spring is located in said first interior chamber of said housing and has a first end portion and a second end portion;

said first end portion of said first bias spring contacts said third wall of said housing;

said second end portion of said first bias spring contacts said second end of said first valve plunger;

said second bias spring is located in said second interior chamber of said housing and has a first portion and a second portion;

said first portion of said second bias spring contacts said third wall of said housing;

said second portion of said second bias spring contacts said second end area of said second valve plunger;

a first fresh water conduit and a second fresh water conduit;

said first fresh water conduit and said second fresh water conduit are adapted for urging said flow of fresh water between said control panel and said fresh water valve assembly;

a third fresh water conduit;

said third fresh water conduit is attached to said fresh water supply connector and said control valve;

a first set of hoses are connected to said first set of discharge ports of said first fresh water valve;

a second set of hoses are connected to said second set of discharge ports of said second fresh water valve;

said first set of hoses are attached to a variety of areas of said first marine engine;

said second set of hoses are attached to a variety of areas of said second marine engine;

wherein fresh flow of fresh water enters said fresh water supply connector and is routed to said control valve via said third fresh water conduit, said control valve isolates said flow of fresh water to either said first fresh water conduit or said second fresh water conduit to allow said flow of fresh water to enter said first fresh water inlet port or said second fresh water inlet port and provides for said first valve plunger or said second valve plunger to linearly move forward and compress said first bias spring or said second bias spring, causing said first set of metering ports or said second set of metering ports to align with said first set of discharge ports or said second set of discharge ports and allow said fresh water to flow into said first set of hoses or said second set of hoses.

7. The flushing system as in claim 6 wherein said first wall and said second wall include a plurality of elongated fins extending outwardly.

8. The flushing system as in claim 6 wherein a front cap is attached to said fourth wall to maintain said first plunger within said first cavity and said second plunger within said second cavity; and said first fresh water inlet port extends through said fourth wall and said second fresh water inlet port extends through said fourth wall.

9. The flushing system as in claim 6 wherein said first end of said first valve plunger includes a first set of O-rings;

said second end of said first valve plunger includes a second set of O-rings;

said first end area of said second valve plunger includes a third set of O-rings; and said second end area of said second valve plunger includes a fourth set of O-rings.

10. The flushing system as in claim 6 wherein said first fresh water conduit is attached to said control valve and said first fresh water inlet port; and said second fresh water conduit is attached to said control valve and said second fresh water inlet port.

11. The flushing system as in claim 6 wherein said valve is a 180-degree valve.

12. A flushing system for a first marine engine, a second marine engine, and a third marine engine in a boat for use whether said boat is in or out of a body of water comprising in combination:

a control panel;

said control panel is mounted interiorly on said boat;

said control panel includes a fresh water supply connector and a control valve;

said fresh water supply connector includes a means for attaching and detaching a pressurized fresh water fluid line in order to allow for a flow of fresh water to enter into said control panel when said pressurized fresh water fluid line is attached to said fresh water supply connector;

a fresh water valve assembly;

said fresh water valve assembly has a housing, a first valve plunger, a second plunger, a third plunger, a first bias spring, a second bias spring, and a third bias spring;

said housing includes a first interior chamber, a second interior chamber, and a third interior chamber;

said housing includes a top, a bottom, a first wall, a second wall, a third wall, and a fourth wall;

said top is parallel to said bottom;

said first wall is parallel to said second wall;

said third wall is parallel to said fourth wall;

said top includes a first set of discharge ports, a second set of discharge ports, and a third set of discharge ports;

said first set of discharge ports is located above said first interior chamber;

said second set of discharge ports is located above said second interior chamber;

said third set of discharge ports is located above said third interior chamber;

a first fresh water inlet port, a second fresh water inlet port, and a third fresh water inlet port for receiving said flow of fresh water are located in said fourth wall;

said first valve plunger is located in said first interior chamber of said housing;

said second valve plunger is located in said second interior chamber of said housing;

said third valve plunger is located in said third interior chamber of said housing;

said first valve plunger includes a first set of metering ports;

said first set of metering ports faces said top of said housing;

said second valve plunger includes a second set of metering ports;

said second set of metering ports faces said top of said housing;

said third valve plunger includes a third set of metering ports;

said third set of metering ports faces said top of said housing;

said first valve plunger includes a first end and a second end;

said first end faces said fourth wall of said housing;

said second valve plunger includes a first end area and a second end area;

said first end area faces said fourth wall of said housing;

said third valve plunger includes a first side and a second side;

said first side faces said fourth wall of said housing;

said first bias spring is located in said first interior chamber of said housing and has a first end portion and a second end portion;

said first end portion of said first bias spring contacts said third wall of said housing;

said second end portion of said first bias spring contacts said second end of said first valve plunger;

said second bias spring is located in said second interior chamber of said housing and has a first portion and a second portion;

said first portion of said second bias spring contacts said third wall of said housing;

said second portion of said second bias spring contacts said second end area of said second valve plunger;

said third bias spring is located in said third interior chamber of said housing and has a first area and a second area;

said first area of said third bias spring contacts said third wall of said housing;

said second area of said third bias spring contacts said second side of said third valve plunger;

a first fresh water conduit, a second fresh water conduit, and a third fresh water conduit;

said first fresh water conduit, said second fresh water conduit, and said third fresh water conduit are adapted for urging said flow of fresh water between said control panel and said fresh water valve assembly;

a fourth fresh water conduit;

said fourth fresh water conduit is attached to said fresh water supply connector and said control valve;

a first set of hoses are connected to said first set of discharge ports of said first fresh water valve;

a second set of hoses are connected to said second set of discharge ports of said second fresh water valve;

a third set of hoses are connected to said third set of discharge ports of said third fresh water valve;

said first set of hoses are attached to a variety of areas of said first marine engine;

said second set of hoses are attached to a variety of areas of said second marine engine;

said third set of hoses are attached to a variety of areas of said third marine engine;

wherein fresh flow of fresh water enters said fresh water supply connector and is routed to said control valve via said fourth fresh water conduit, said control valve isolates said flow of fresh water to either said first fresh water conduit, second fresh water conduit, or said third fresh water conduit to allow said flow of fresh water to enter said first fresh water inlet port, said second fresh water inlet port, or said third fresh water inlet port and provides for said first valve plunger, said second valve plunger, or said third valve plunger to linearly move forward and compress said first bias spring, said second bias spring, or said third bias spring, causing said first set of metering ports, said second set of metering ports, or said third set of metering ports to align with said first set of discharge ports, said second set of discharge ports, or said third set of discharge ports and allow said fresh water to flow into said first set of hoses, said second set of hoses, or said third set of hoses.

13. The flushing system as in claim 12 wherein said first wall and said second wall include a plurality of elongated fins extending outwardly.

14. The flushing system as in claim 12 wherein a front cap is attached to said fourth wall to maintain said first plunger within said first cavity, said second plunger within said second cavity, and said third plunger within said third cavity; and said first fresh water inlet port extends through said fourth wall, said second fresh water inlet port extends through said fourth wall, and said third fresh water inlet port extends through said fourth wall.

15. The flushing system as in claim 12 wherein said first end of said first valve plunger includes a first set of O-rings;

said second end of said first valve plunger includes a second set of O-rings;

said first end area of said first valve plunger includes a third set of O-rings;

said second end area of said second valve plunger includes a fourth set of O-rings;

said first side of said third valve plunger includes a fifth set of O-rings; and said second side of said third valve plunger includes a sixth set of O-rings.

16. The flushing system as in claim 12 wherein said first fresh water conduit is attached to said control valve and said first fresh water inlet port;

said second fresh water conduit is attached to said control valve and said second fresh water inlet port; and said third fresh water conduit is attached to said control valve and said third fresh water inlet port.

17. The flushing system as in claim 12 wherein said control valve is a four way valve.

* * * * *